US006328646B1

(12) United States Patent
Abe et al.

(10) Patent No.: US 6,328,646 B1
(45) Date of Patent: Dec. 11, 2001

(54) COIN HOPPER TRANSPORTATION WITH ENDLESS BELT CONVEYOR

(75) Inventors: Hiroshi Abe; Masayoshi Umeda, both of Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 0 days.

(21) Appl. No.: 09/506,982

(22) Filed: Feb. 18, 2000

(30) Foreign Application Priority Data

Feb. 24, 1999 (JP) ..... 11-093260
Sep. 6, 1999 (JP) ..... 11-251652

(51) Int. Cl.[7] ..... G07D 1/00

(52) U.S. Cl. ..... 453/56; 453/57; 453/17; 221/174; 221/203; 198/550.01; 198/550.5; 198/562

(58) Field of Search ..... 453/17, 56, 57; 221/168, 174, 200, 203; 198/396, 540, 550.01, 550.2, 550.3, 550.4, 550.5, 550.6, 550.7, 550.8, 550.9, 562

(56) References Cited

U.S. PATENT DOCUMENTS 2,395,732 * 2/1946 Fulton ..... 198/550.5
3,061,145 10/1962 Sharpe .
3,680,566 * 8/1972 Tanaka et al. ..... 133/3
4,535,794 8/1985 Bellis et al. .
5,152,391 * 10/1992 Campell ..... 198/550.01
5,165,520 * 11/1992 Herve et al. ..... 198/460
5,190,495 * 3/1993 Taxon ..... 453/32
5,333,718 * 8/1994 Pannell et al. ..... 198/397
5,496,211 * 3/1996 Zimmermann ..... 453/3
5,775,537 * 7/1998 Doyle, Jr. ..... 221/85
5,954,576 * 9/1999 Coulter et al. ..... 453/17
6,003,652 * 12/1999 Murata et al. ..... 194/206
6,030,284 * 2/2000 Frank ..... 453/3
6,174,230 * 1/2001 Gerrity et al. ..... 453/57

FOREIGN PATENT DOCUMENTS

2459251 * 7/1975 (DE) ..... 453/56
3611607A * 10/1987 (DE) ..... 198/550.01
786596 9/1935 (FR) .

* cited by examiner

*Primary Examiner*—Christopher P. Ellis
*Assistant Examiner*—Jeffrey A. Shapiro
(74) *Attorney, Agent, or Firm*—Price and Gess

(57) ABSTRACT

The large-capacity coin dispensing apparatus of the present invention is directed to increasing the coin storage capacity of a hopper-type coin dispensing apparatus using a rotary disc to dispense coins one at a time. The coin storage capacity of the hopper-type coin dispensing apparatus is limited by the storage capacity of a hopper used to supply coins to the rotary disc. To increase coin storage capacity, the present invention uses a first tank to supply coins to the rotary disc and a second tank to hold a large supply of coins. As the coins in the first tank are depleted, coins are transported from the second tank to the first tank using a conveyor. The addition of the second tank increases coin storage capacity and reduces the frequency at which coins have to be loaded into the large-capacity coin dispensing apparatus.

19 Claims, 19 Drawing Sheets

COIN HOPPER TRANSPORTATION WITH ENDLESS BELT CONVEYOR

BACKGROUND OF THE INVENTION

1. Field of the Invention

The present invention relates to a coin dispensing apparatus and more particularly to a coin dispensing apparatus having a large coin storage capacity including a first tank, a second tank for storing a large supply of coins and a conveyor for transferring coins from the second tank to the first tank.

2. Description of the Related Art

U.S. Pat. No. 4,589,433 discloses a first type of hopper-type coin dispensing apparatus. FIG. 9 shows a perspective view of the coin dispensing apparatus including a support stand 1, a base plate 2 mounted to the support stand 1 in a position inclined to a horizontal surface and a hopper head 3 secured to the base plate 2 by bolts 4 to form a hopper 5 for holding a supply of coins. The coin dispensing apparatus further includes a rotary disc 6 rotatably mounted to the support plate 2 within the hopper 5. A peripheral portion 6*a* of the rotary disc is provided with a plurality of pins 8 arranged at regular intervals. A central portion of the rotary disc 6 is provided with an overlaying central disc 9. The outer edge of the central disc 9*a* and the plurality of pins 8 define spaces on the rotary disc 6 for picking up coins from the hopper 5 and transporting them to a delivery zone 7. Three agitating coils 15, extending radially from the center of the rotary disc 6, stir the coins in the hopper. A delivery knife secured to the support plate 2 at the delivery zone 7 and having a tip 10*a* resting on the outer edge of the central disc 9*a* transfers coins from the rotary disc 6 to an exit chute 11. A roller 13 positioned above the delivery knife 10 and rotatably mounted to the free end of a spring loaded actuator arm 12 counts the number of coins as they pass between the roller 13 and the delivery knife 10. Elliptically shaped wipers 14, each secured to the support plate 2 by a mouth piece 16, prevent any overlapping of coins on the rotary disc 6 from being transported to the exit chute 11. Each wiper 14 includes a deflection plate 17 for pushing the wiper 14 against an upper circumferential wall 19 to define a clearance between the wiper and the rotary disc 6.

U.S. Pat. No. 5,122,094 discloses a second type of hopper-type coin dispensing apparatus. FIG. 18 shows a perspective view of this type of coin dispensing apparatus including a support stand 103, a base plate 104 in a position inclined to the horizontal and a hopper 101 secured to the supporting plate 104 for holding a supply of coins. The second coin dispensing apparatus further includes a rotary disc 150 connected to a rotary shaft 142 of a motor and rotated in the clockwise direction A. The rotary disc 150 has a thick bottom and an integrally formed circumferential wall 106. The bottom of the rotary disc 150 has circumferentially spaced holes 152 for receiving coins. An under surface of the rotary disc 150 includes coin feeding arms 153 each of which extends from a peripheral edge of the rotary disc 150 to one of the holes 152 at an angle to the radial direction of the rotary disc 150 (see FIG. 19). Each of the coin feeding arms 153 has a thickness slightly smaller than the thickness of a coin. A support mount 154 under the rotary disc 150 and centered with the rotary shaft 142 rotatably supports the rotary disc 150. The support mount 154 has a thickness slightly larger than the thickness of the coin. As the rotary disc 150 is rotated clockwise A, coins drop one by one through the holes 152 and between the feeding arms 153 under the rotary disc 150. The feeding arms 153 transport the coins upwardly to a coin exit 160. A guiding elliptical plate 155 is fitted around the support mount 154 under the rotary disc 150. The guiding plate 155 includes a linear portion 156 for guiding coins transported upwardly on the feeding arms 153 into the coin exit 160. A lower portion of the coin exit 160 includes a first roller 161 rotatably supported on a roller shaft 162 fixed to the base plate 104. An upper portion of the coin exit 160 includes a movable roller 163 rotatably supported on a movable shaft 164 that moves along an arched groove 165 formed in the base plate 104. The movable shaft 164 is connected to a spring loaded actuator arm 166 pivotable secured by a pin 168 to a bracket 167 fixed to the supporting plate 104. A count sensor 169 secured to the bracket and operated by the actuator arm 166 counts the number of coins as they pass between the first roller 162 and the movable roller 166.

A problem that has occurred in hopper-type coin dispensing apparatuses is the relatively low coin storage capacity of their hopper. This problem is especially pronounced in the gaming industry which relies on coin dispensing apparatuses in game machines to continuously pay out coins to players at high speeds. Game machines are more likely to experience coin shortages in the middle of a play because of the low coin storage capacity of the hopper. Therefore, there is a need to increase the coin storage capacity of both hopper-type coin dispensing apparatuses to avoid coin shortages.

SUMMARY OF THE PRESENT INVENTION

The object of the present invention is to provide a coin dispensing apparatus having a large coin storage capacity with simple construction.

A first embodiment of the present invention includes a first storage tank and a rotary disc having a central disc and a plurality of members for transporting coins from the storage first tank to an exit chute. The first embodiment further includes a case secured to the first storage tank and housing a belt-type conveyor, and a second storage tank secured to the case and having a large coin storage capacity. As the coin supply of the first storage tank is depleted, the coins stored in the second storage tank are transported to the first storage tank using the belt-type conveyor in the case. The second storage tank allows the coin dispensing apparatus of the first embodiment to continuously pay out coins for longer periods of time and reduces the frequency at which coins have to be loaded into the coin dispensing apparatus.

A second embodiment of the invention includes a cylindrical first storage tank and a rotary disc having coin receiving holes and coin feeding arms for transporting coins from the storage first tank to a coin exit. The second embodiment further includes a case secured above the first storage tank and housing a conveyor, and a second storage tank secured to the case and having a large coin storage capacity. As the coin supply of the first storage tank is depleted, the coins stored in the second storage tank are transported to the first storage tank using the conveyor in the case. The second storage tank allows the coin dispensing apparatus of the second embodiment to continuously pay out coins for longer periods of time and reduces the frequency at which coins have to be loaded into the coin dispensing apparatus.

DESCRIPTION OF DRAWINGS

The exact nature of the present invention will be readily apparent from consideration of the following detailed description in conjunction with the accompanying drawings, wherein.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide an improved large-capacity coin dispensing apparatus.

Figure 1:
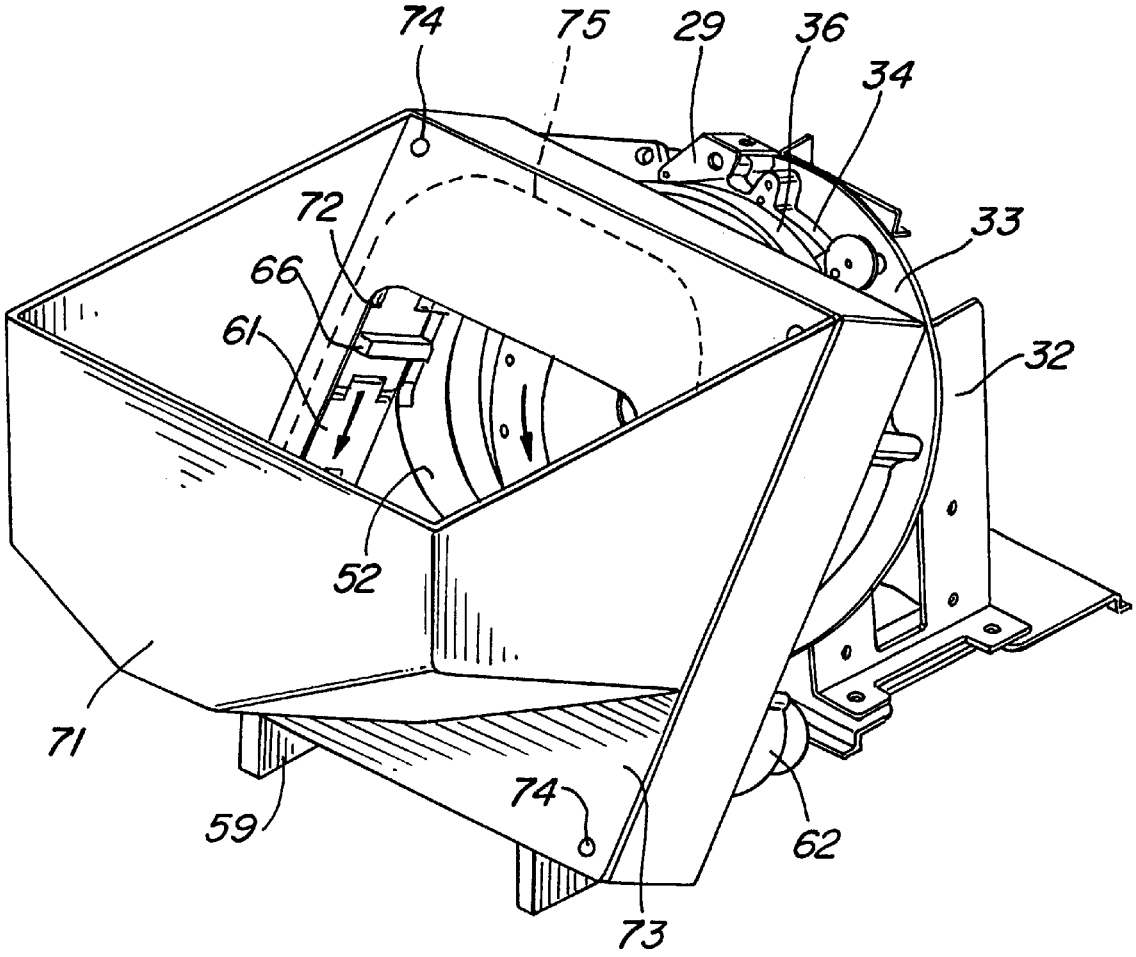
FIG. 1 is a perspective view of the coin dispensing apparatus of the first embodiment.
Figure 2:
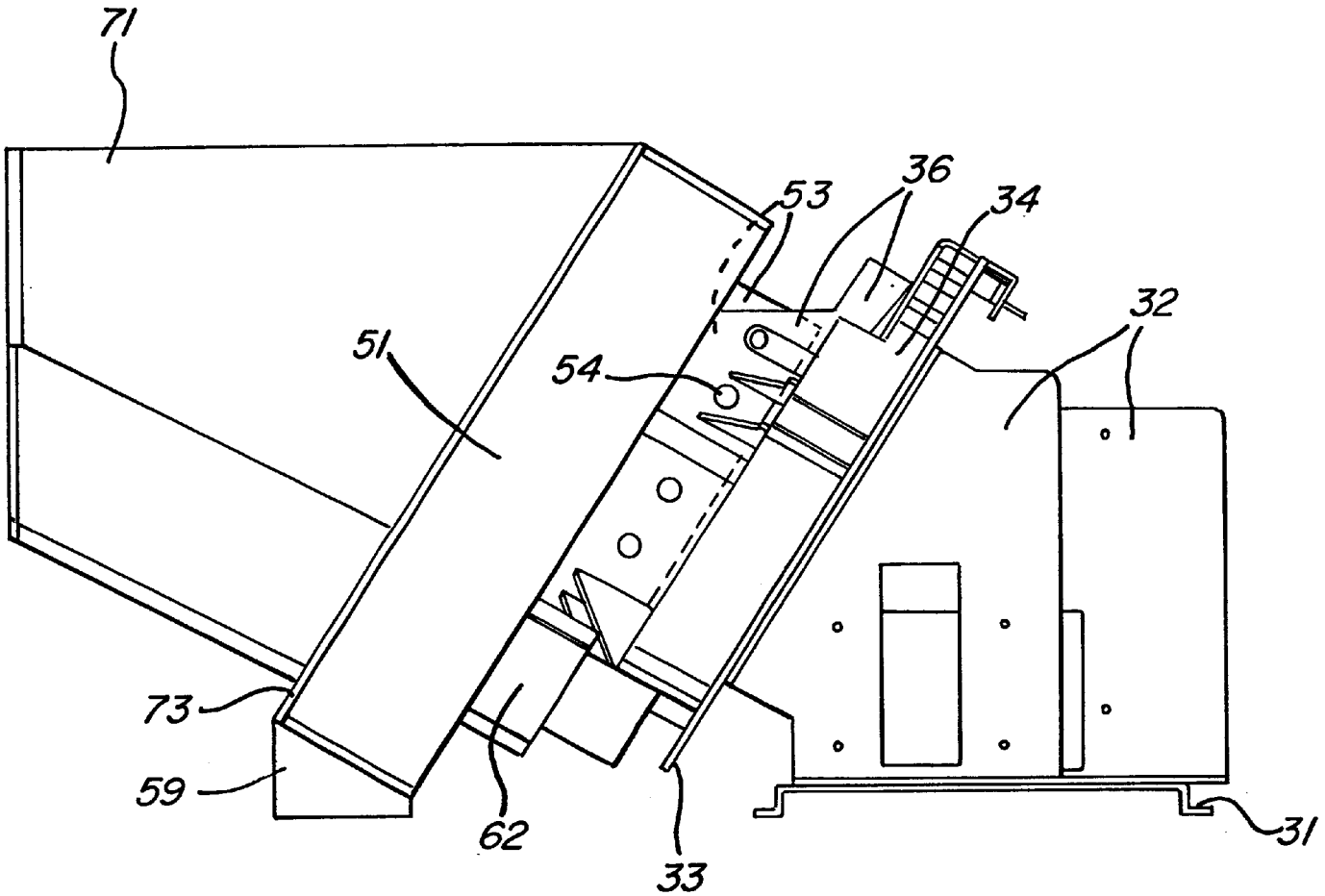
FIG. 2 is a side view of the coin dispensing apparatus in FIG. 1.

FIG. 1 shows a first preferred embodiment of a large-capacity coin dispensing apparatus of the present invention. The large-capacity coin dispensing apparatus of the first embodiment includes a rectangular bed plate 31 for installing the coin dispensing apparatus in the housing of a machine requiring a large coin dispensing capability, such as a casino gaming machine. A support stand 32 is fixed to the rectangular bed plate 31, and a base plate 33 is mounted on the support stand 32 in a position inclined to an intended horizontal support surface. The large-capacity coin dispensing apparatus further includes a circumferential wall 34 surrounding a rotary disc 35 rotatably mounted to the base plate 33 and a first coin storage tank 36 secured to the circumferential wall 34 (see FIG. 2).

Figure 3:
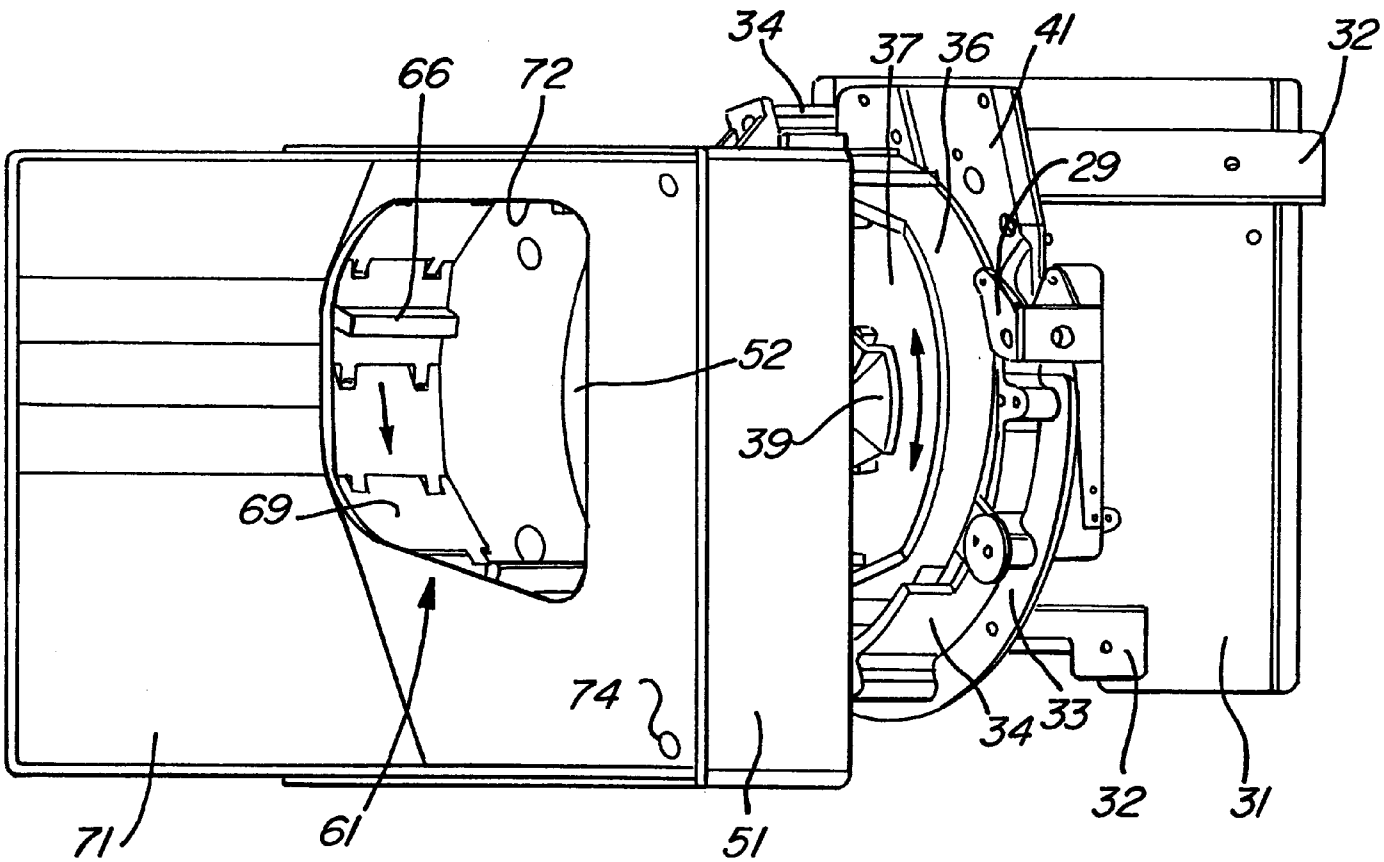
FIG. 3 is top view of the coin dispensing apparatus in FIG. 1.
Figure 4:
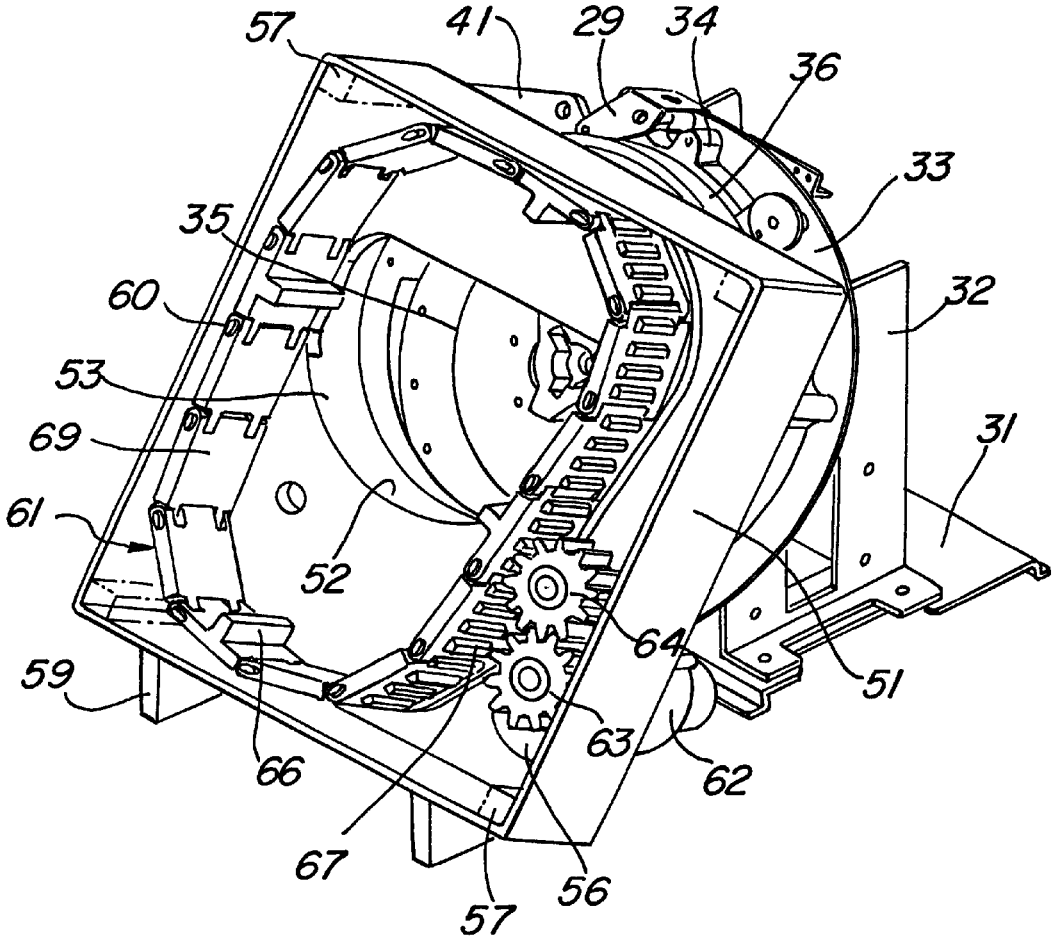
FIG. 4 is a perspective view of the coin dispensing apparatus in FIG. 1 shown with a portion of the apparatus removed.
Figure 5:
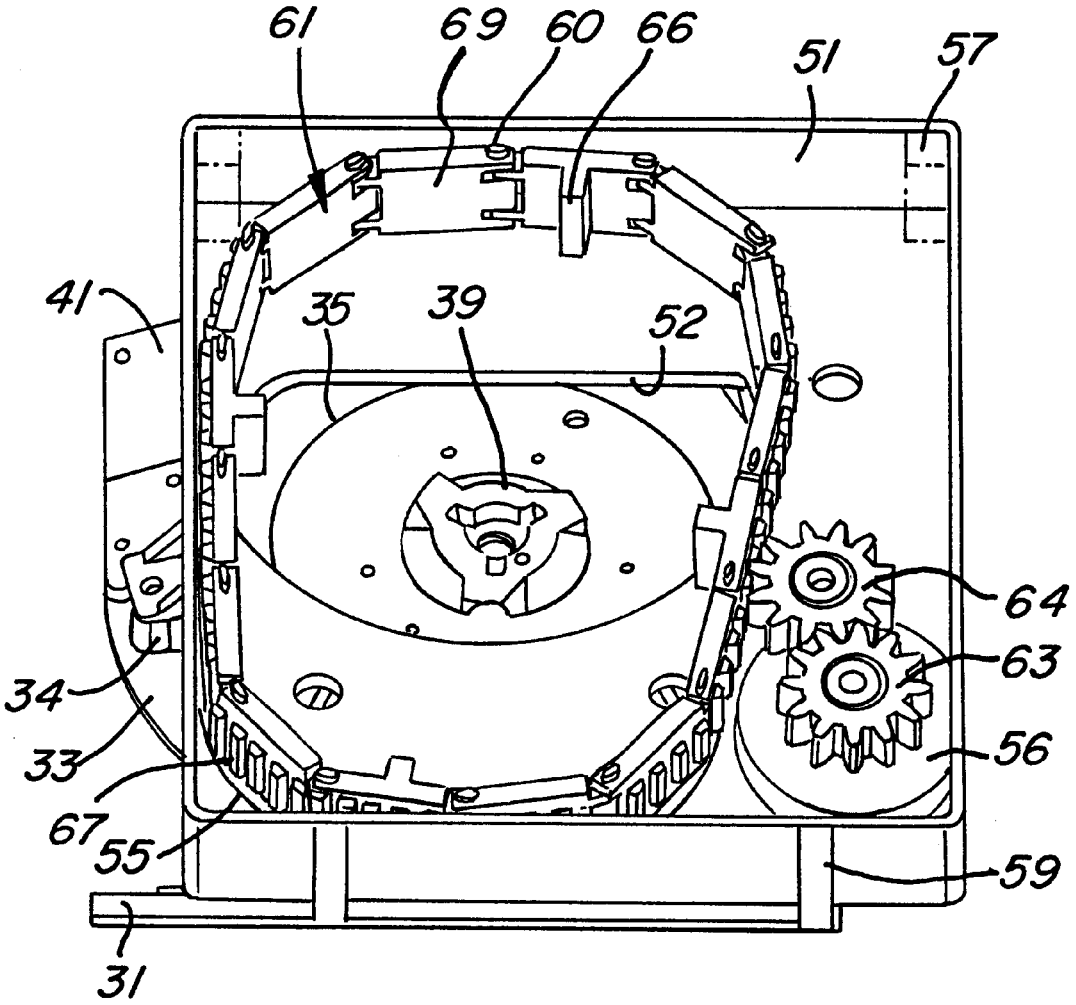
FIG. 5 is a front view of the coin dispensing apparatus in FIG. 4.

A case 51 made from molded resin or metal is secured to the first tank 36 in a position inclined to the horizontal. The side of the case 51 adjacent to the first tank 36 has a semicircular opening 52, as seen in FIG. 3, for transferring coins from the case 51 to the first tank 36. The case 51 includes an outwardly protruding circular wall 53 surrounding the semicircular opening 52. The outwardly protruding circular wall 53 is inserted into the first tank 36 and secured to the first tank 36 by screws 54 (see FIG. 2). The case 51 also includes a first guide rail 55 surrounding the semicircular opening 52 (see FIGS. 6 and 7). The first guide rail 55 is used for guiding a belt-type conveyor 61 within the case 51 to be discussed later. The bottom right-hand of the case 51 includes a circular housing 56 for supporting an electric motor 62 which protrudes outside the case 51. A first gear 63, connected to a driving shaft of the electric motor 62, rotates on top of the circular housing 56. A second gear 64 rotatably mounted to the circular housing 56, engages the first gear 63 (see FIGS. 4 and 5). The case 51 further includes a pair of legs 59 for resting the case 51 on a horizontal surface and screw holes 57 at each inner corner.

A large second tank 71 made from molded resign or metal is used for storing a large supply of coins. One side of the second tank 71 consist of a rectangular face plate 73 for securing the second tank 71 to the case 51 (see FIG. 1). The face plate 73 is secured to the case 51 by screws 74 inserted into the screw holes 57 of the case 51. The second tank 71 is secured to the case 51 in a position inclined to the horizontal (see FIG. 2). The face plate 73 also forms a cover plate for the case 51 and has a rectangular opening 72 for transferring coins from the second tank 71 into the case 51. Because the second tank 71 is inclined to the horizontal, coins in the second tank 71 flow into the case 51 through the rectangular opening 72 due to gravity. The rectangular opening 72 extends to a lower interior surface of the second tank 71 so that all the coins in the second tank 71 eventually flow into the case 51 as the coins in the case 51 are depleted. To ensure that all the coins in the case 51 flow into the case 51, the bottom of the case 51 is lower than the bottom of the second tank 51 (see FIG. 2). The second tank 71 also includes a second guide rail 75 on the face plate 73 running parallel to the first guide rail 55. The first rail 55 and the second rail 75 guide work in conjunction to guide the belt-type conveyer 61 within the case 51.

Figure 6:
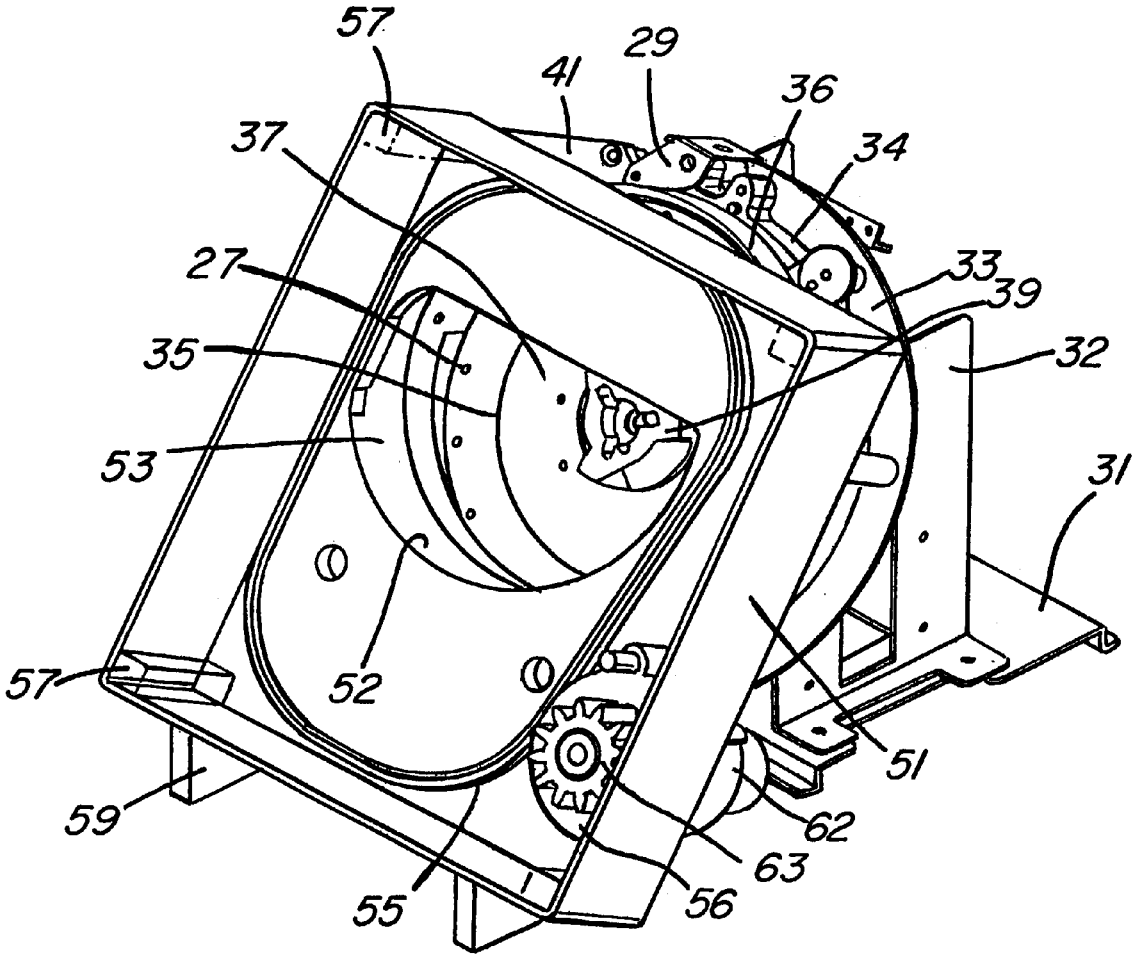
FIG. 6 is a perspective view of the coin dispensing apparatus in FIG. 4 shown with a portion of the apparatus removed.
Figure 7:
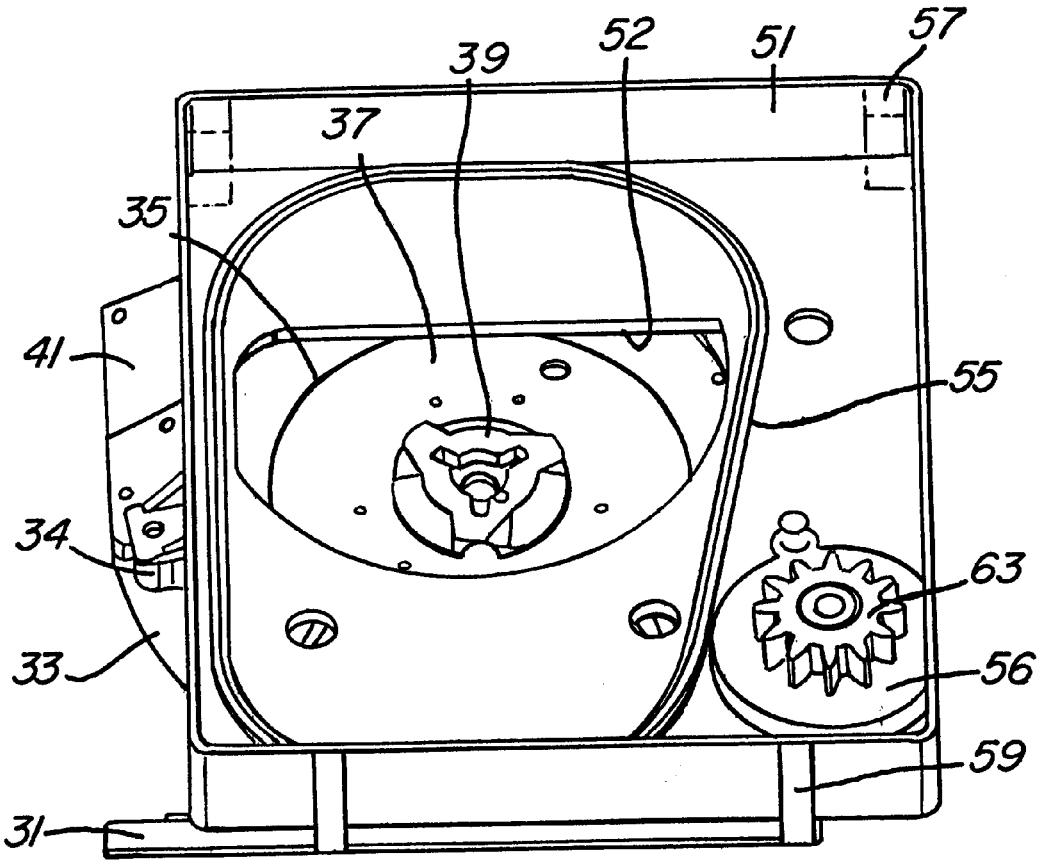
FIG. 7 is a front view of the coin dispensing apparatus in FIG. 6.
Figure 8:
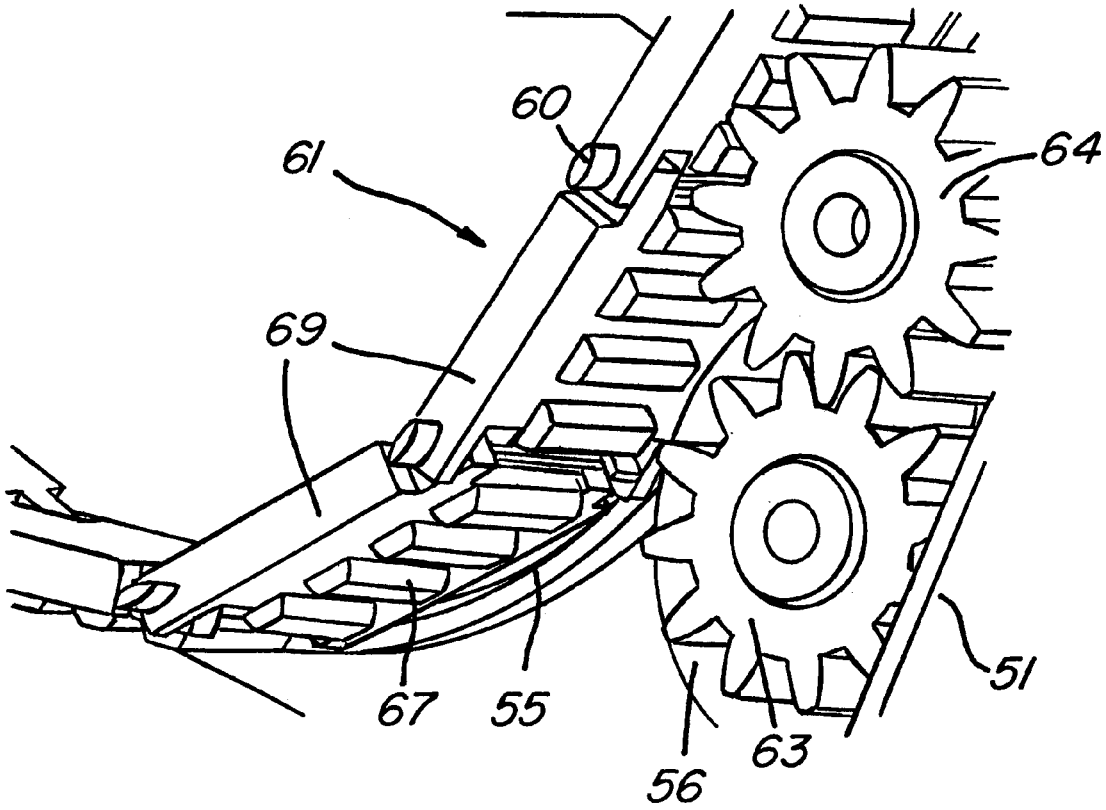
FIG. 8 is an enlarged perspective view of the lower right-hand section of the coin dispensing apparatus in FIG. 4.
Figure 9:
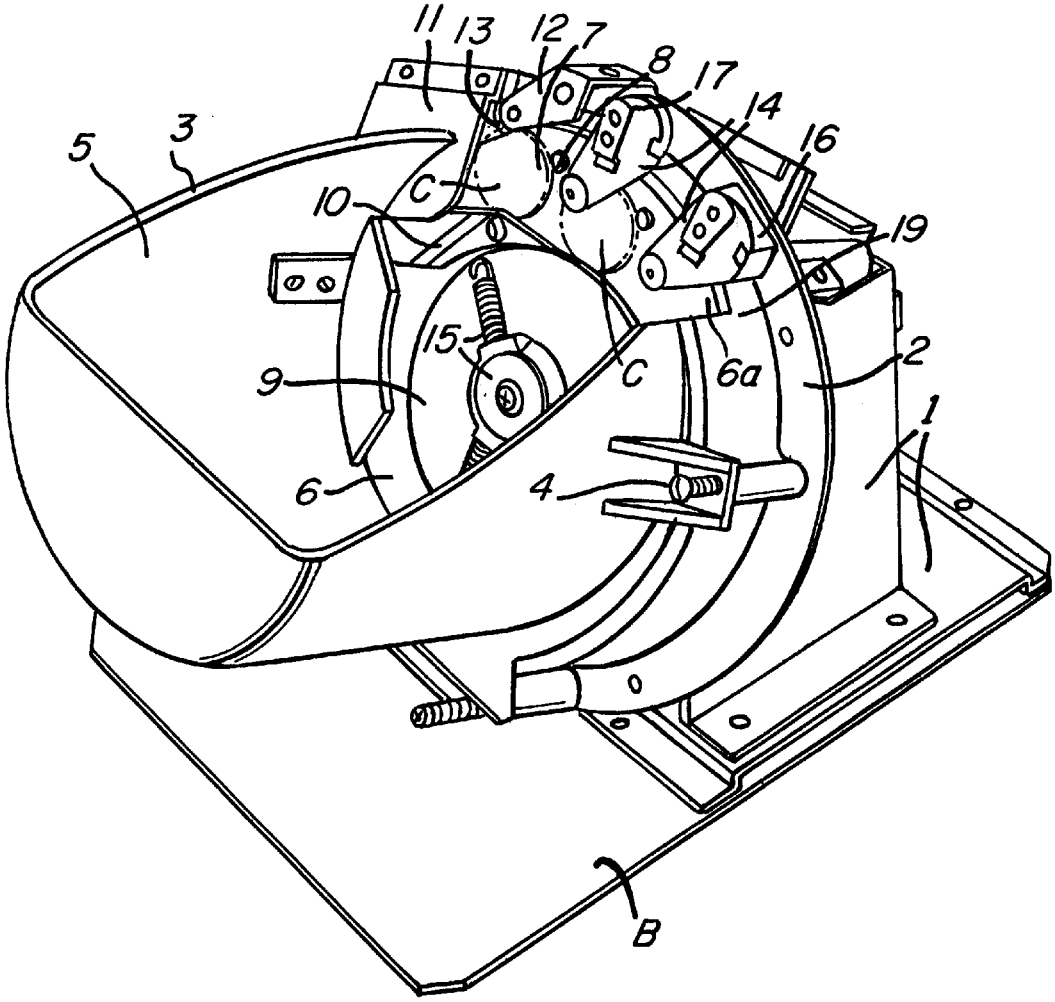
FIG. 9 PRIOR ART
FIG. 9 is a perspective view of a first hopper-type coin dispensing apparatus of the prior art.

The belt-type conveyer 61 shown in FIG. 8 comprises rectangular segments 69 connected by hinge pins 60 to form an endless loop. The bottom surface of the rectangular segments 69 include small racks 67 for engaging the second gear 64 to rotate the belt-type conveyer 61. The belt-type conveyor rotates freely within the case 51 guided between the first rail 55 and the second rail 75. The top surface of several of the rectangular segments 69 include perpendicular projection plates 66 extending horizontally across the width of the conveyor 61 for lifting coins with in the case 51, as shown in FIG. 6, every fourth segment has an upright projection plate 66 to facilitate a fast rotation of the endless loop. The bottom of the belt-type conveyor 69 loop is positioned below or coplanar with the lower interior surface of the second tank 71. This is done so that coins from the second tank 71 flow onto the bottom of the conveyor 69 loop through the rectangular opening 72 (see FIG. 3).

The coins in the first tank 36 are then transported to an exit chute 41 in a manner similar to the transport of coins from the hopper 5 to the exit chute 11 in the first hopper-type coin dispensing apparatus of the prior art. A rotary disc 35 having a central disc 37 and a plurality of pins 27 corresponds to the rotary disc 6 having the central disc 9 and plurality of pins 8 of the prior art. In addition, three agitating coils 39 and a spring loaded actuator arm 29 correspond the agitating coils 15 and the actuator arm 12 of the prior art. The outer edge of the central disc 37 and the plurality of pins 27 define spaces on the rotary disc 35 for picking up coins and transporting them upwardly to the exit chute 41.

The large-capacity coin dispensing apparatus of the first embodiment increases coin capacity by storing a reserve of coins in the second tank 71. The coins in the second tank 71 flow into the case 51 through the rectangular opening 72. Because the case 51 is inclined to the horizontal, the coins in the case 51 initially flow into the first tank 36 through the semicircular opening 52 due to gravity. This occurs as long as the height of the coin supply in the case 51 is above the semicircular opening 52. During this time, the belt-type conveyor 61 is not needed to lift the coins in the case 51 to the semicircular opening 52. When the height of the coin supply in the case 51 drops below the semicircular opening 52, the electric motor 62 is activated to drive the belt-type conveyor 61 and lift the coins in the case 51 to the semicircular opening 52. The electric motor 62 can be activated by a sensor (not shown) which detects the coin supply in the first tank 36. The sensor can be of a type which is activated by the weight of coins in the second tank 71 or, alternatively, by an optical transmission and reception of light which can be blocked by the level of coins. The coins in the case 51 are lifted to the opening 52 on the projection plates 66 of the belt-type conveyor. When the projection plates 66 reach the semicircular opening 52, the coins slide off the projection plates 66 and drop into the first tank 36 through the opening 52. The coins slide off the projection plates 66 and drop into the first tank 36 because the case 51 is inclined to the horizontal by a sufficient angle to enable the coins to fall by gravity directly into the fist tank 36.

The large-capacity coin dispensing apparatus increases coin capacity over the prior art coin dispensing apparatus by adding a second tank to hold a large supply of coins and by providing an intermediate rotating belt-type conveyor. The second tank 71 feeds coins to the first tank 36 via the belt-type conveyor 61 when coin depletion is detected in the first tank. For example, coin depletion in the first tank can be detected by a sensor (not shown) that senses the weight of the coin load of the rotary disc 35 by a strain gauge. When the coin load of the rotary disc 35 is reduced, the motor 62 driving the belt-type conveyor 61 is activated to transport coins from the second tank 71 to the first tank 36. A huge benefit of the coin dispensing apparatus of the present invention to the gaming industry is that it allows game machines to continuously payout coins for longer periods of time.

Those skilled in the art will appreciate that various adaptations and modifications of the just-described first preferred embodiment of the present invention can be made without departing from the scope and spirit of the invention. For example, an endless rubber belt, leather belt or textile belt can be used in place of the belt-type conveyor 61 of the present invention. Also, a chain-like conveyor can be used in place of the belt-type conveyor 61. In this case, the chain-like conveyor is rotated by a sprocket wheel wherein the sprockets of the sprocket wheel fit into the links of the chain-like conveyor. In addition, a bucket conveyor can be used in place of the belt-type conveyor wherein coins are dumped into the first tank 36 by inverting the buckets of the bucket conveyor as they pass over the semicircular opening 52. Furthermore, spoons or pots can be used in place of the projection plates 66 of the belt-type conveyor 61 to lift the coins in the case 51. Those skilled in the art will also appreciate that, with some modification to the coin dispensing apparatus of the first embodiment, the rotary disc can be replaced by the rotary disc of the second hopper-type coin dispensing apparatus.

Figure 10:
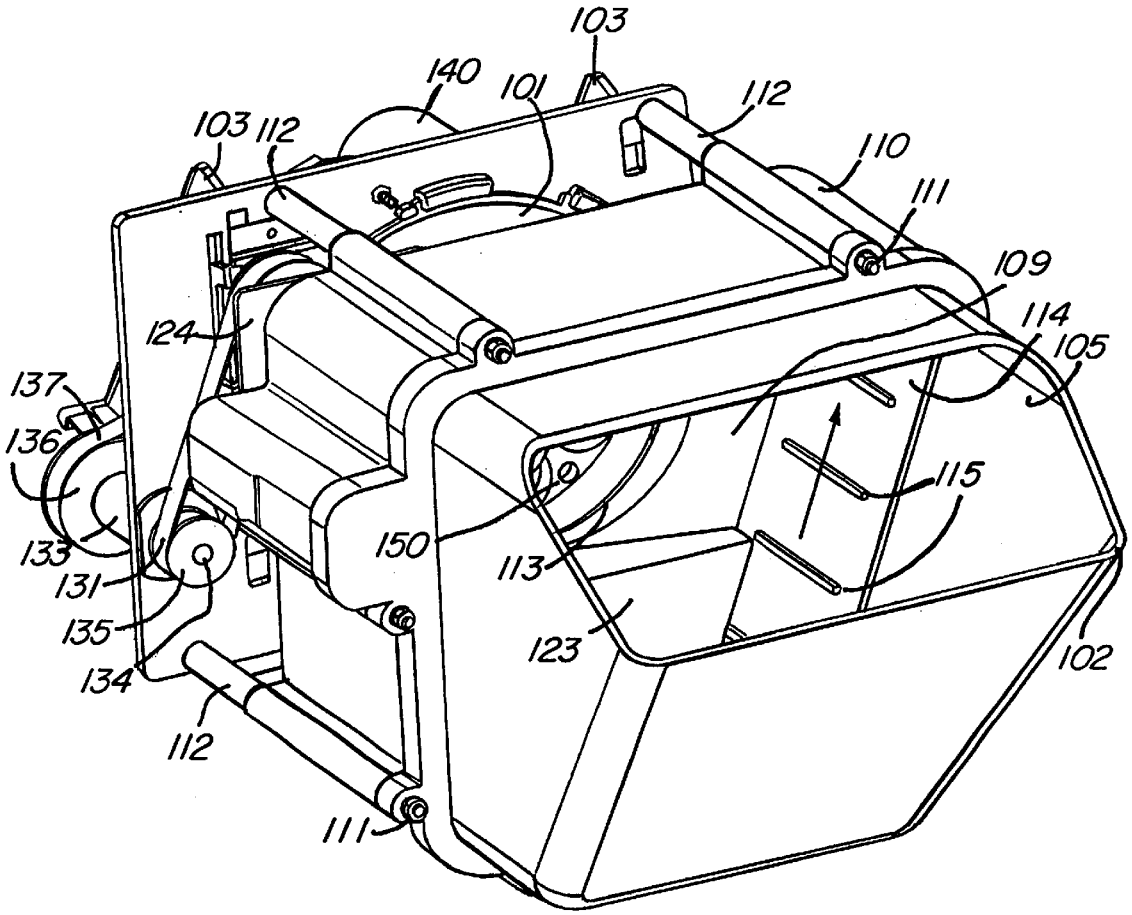
FIG. 10 is a perspective view of the coin dispensing apparatus of the second embodiment.
Figure 11:
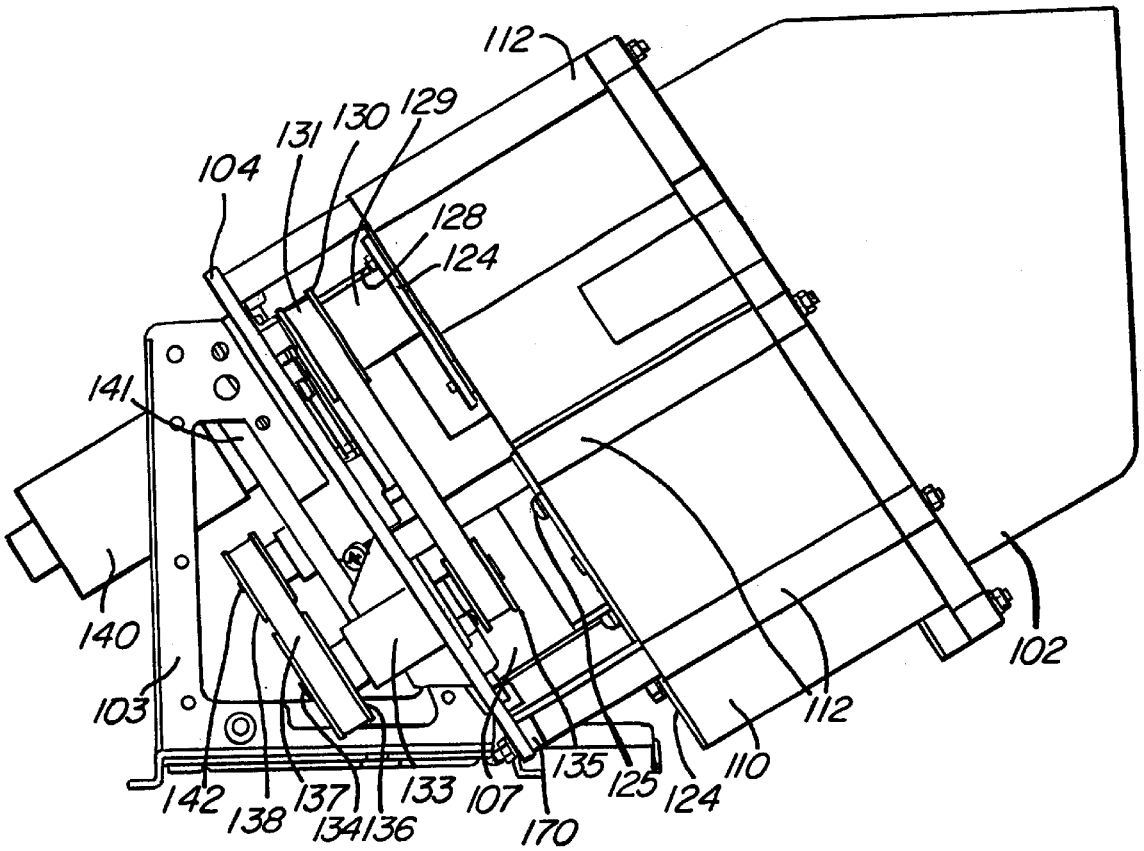
FIG. 11 is a side view of the coin dispensing apparatus in FIG. 10 shown from the left side.
Figure 14:
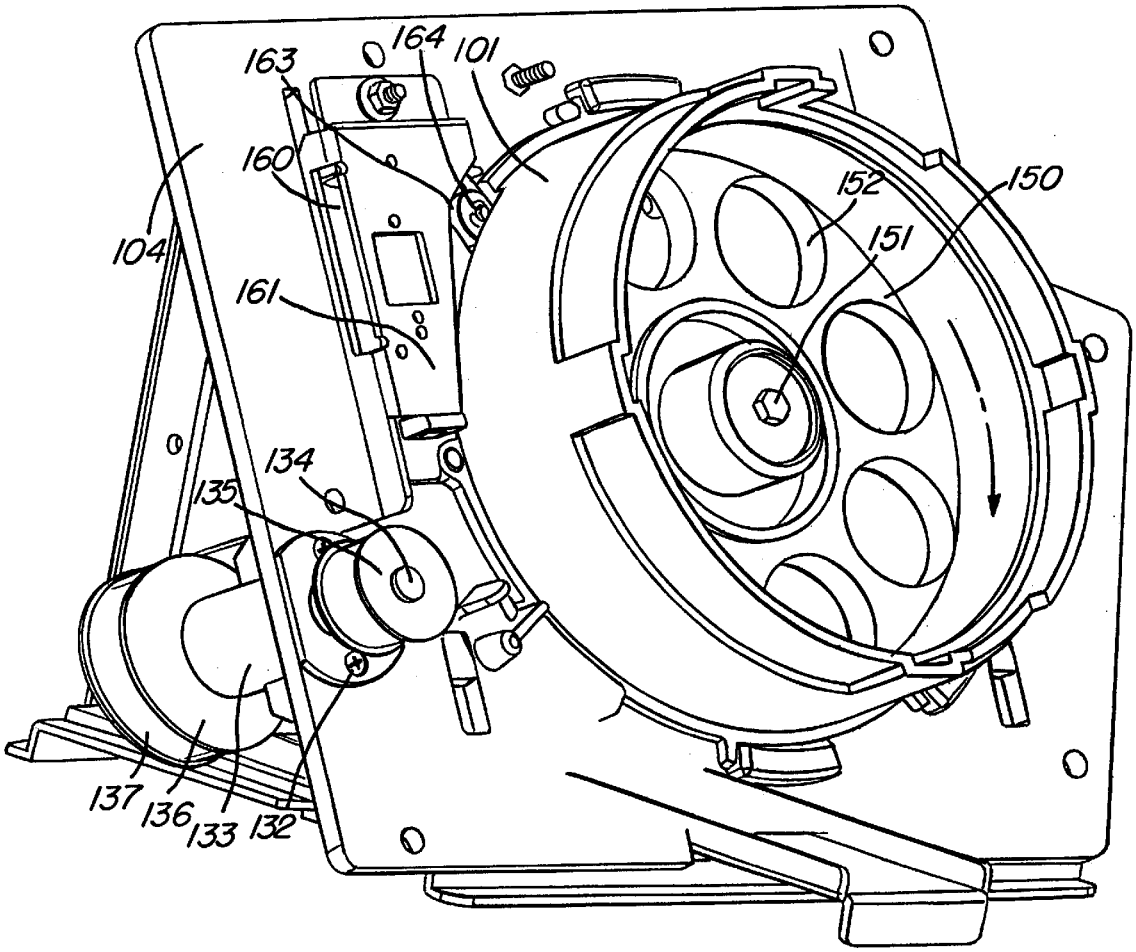
FIG. 14 is an enlarged perspective view of the coin dispensing apparatus in FIG 10 with a major portion of the apparatus removed.
Figure 15:
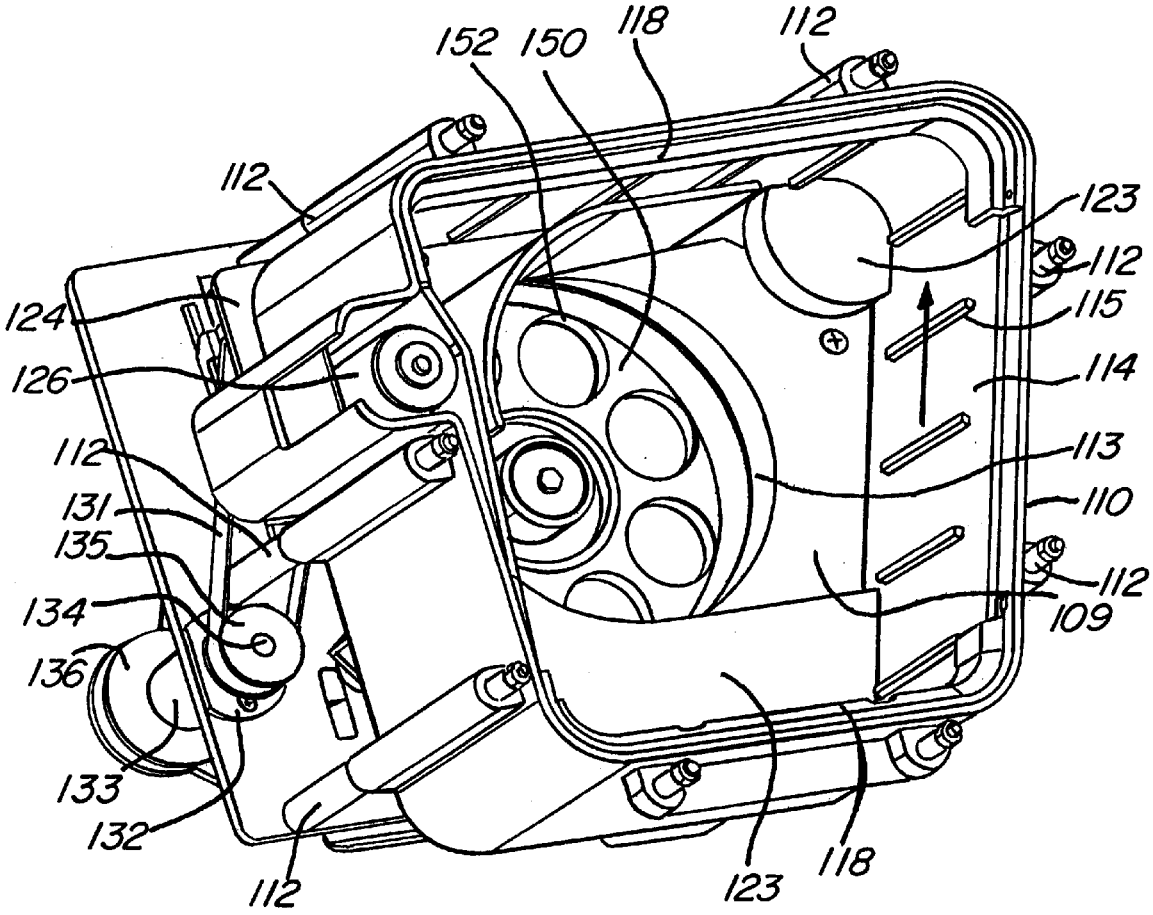
FIG. 15 is an enlarged perspective view of the coin dispensing apparatus in FIG. 10 with a portion of the apparatus removed.

FIG. 10 shows a second preferred embodiment of the large-capacity dispensing apparatus of the present invention. Parts that are common to both the coin dispensing apparatus of the second embodiment and the second hopper-type coin dispensing apparatus of the prior art are given the same reference numbers for convenience. The large-capacity coin dispensing apparatus of the second embodiment includes a support stand 103, a base plate 104 mounted on the support stand 103 in a position inclined to the horizontal, and a cylindrical first tank 101 secured to the base plate 104 (see FIG. 14). Within the cylindrical first tank 101 is a rotary disc 150 rotably mounted to the base plate 104. The coin dispensing apparatus further includes a rectangular barrel case 110 secured to the base plate 104 in a position inclined to the horizontal (see FIG. 1). The barrel case 110 is secured to the base plate 104 by bolts 111 exiting six long legs 112. The long legs 112 hold the barrel case 110 above the cylindrical first tank 101. The barrel case 110 includes a conveyor belt 114 running along the inner wall of the barrel case 110 (see FIG. 15). The bolts 111 also secures a second tank 102 to the barrel case 110 at an incline to the horizontal (see FIG. 11). The second tank 102 has a large opening to the barrel case 10 and is used for storing a large supply of coins.

Figure 12:
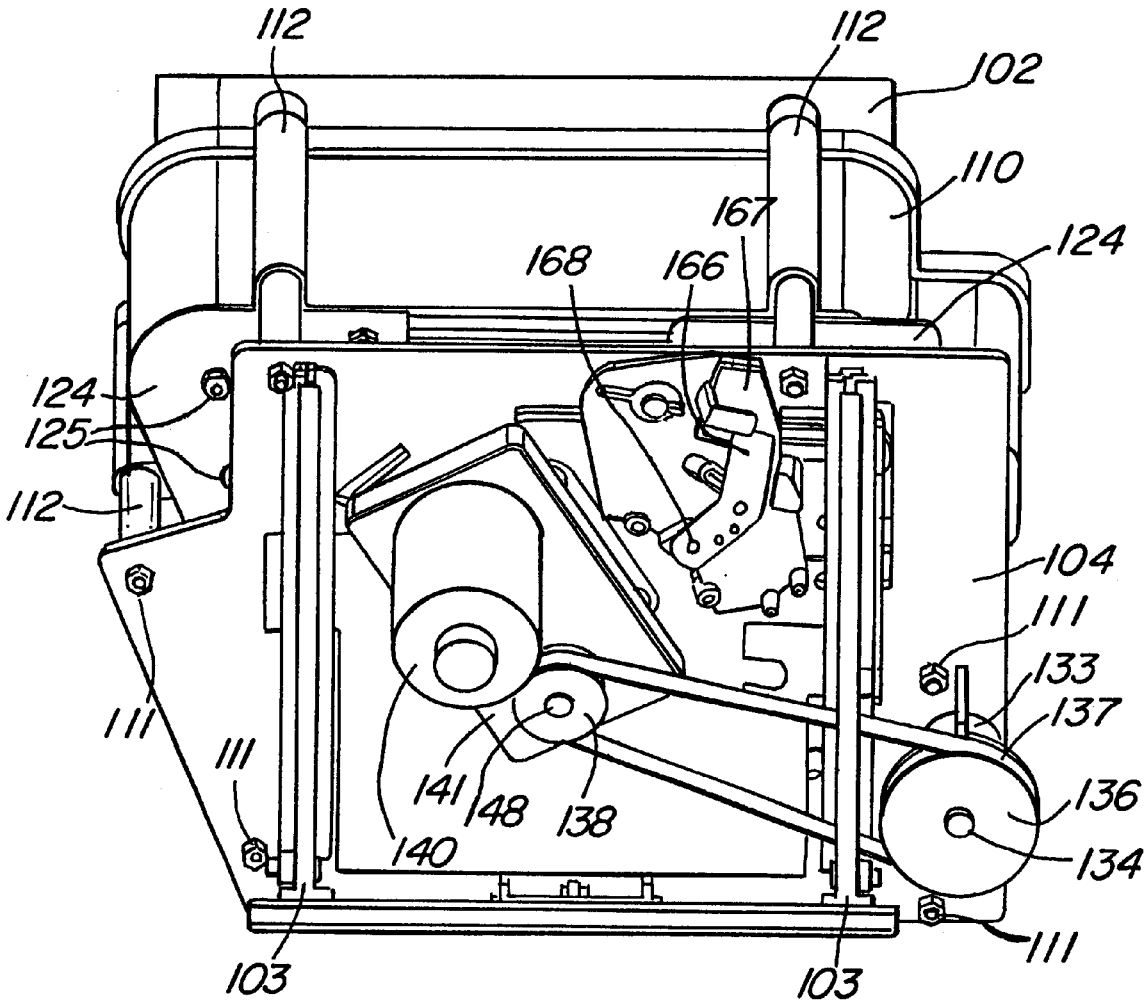
FIG. 12 is a rear view of the coin dispensing apparatus in FIG. 10.
Figure 13:
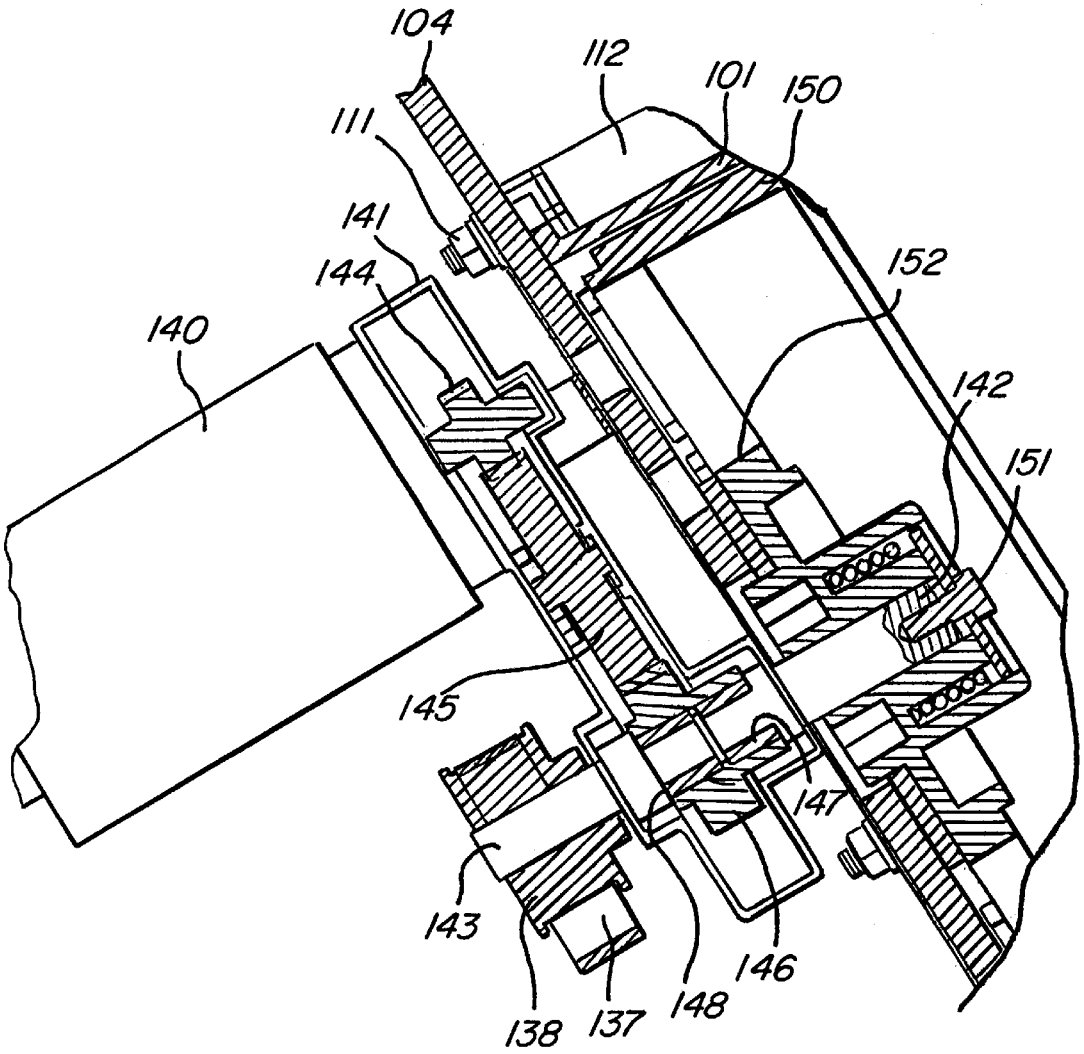
FIG. 13 is an enlarged sectional view of the coin dispensing apparatus in FIG. 11.

A gear case 141 is secured to the back surface of the base plate 104 by screws and a motor 140 is secured to the top of the gear case 141 by screws (see FIG. 12). The gear case 141 houses a pinion 144 fixed to a motor shaft of the motor 140, a large gear 145 which engages the pinion 144, and an output gear 146 which engages the large gear 145 (see FIG. 13). The gear case 141 also houses a first clutch 147 and a second clutch 148 both of which engage the output gear 146. A first output shaft 142 is driven by the first clutch 147 when the motor 140 rotates in a positive direction and a second output shaft 143 is driven by the second clutch 148 when the motor 140 rotates in a reverse direction.

The first output shaft 142 is connected to the rotary disc 150 within the first tank 101 and rotates the rotary disc 150 when the motor 140 rotates in the positive direction. The rotary disc 150 transports coin from the first tank 101 to a coin exit 160 in a manner similar to the transport of coins from the hopper 101 to the coin exit 160 in the second hopper-type coin dispensing apparatus of the prior art. The rotary disc 150 of the second embodiment has circumferentially spaced coin receiving holes 152. An under surface of the rotary disc 150 includes coin feeding arms 153 each of which extends from a peripheral edge of the rotary disc 150 to one of the holes 152. A support mount 154 under the rotary disc 150 and centered with a rotary shaft 142 rotatably supports the rotary disc 150. As the rotary disc 150 is rotated clockwise, coins drop one by one through the holes 152 and between the feeding arms 153 under the rotary disc 150. The feeding arms 153 then transport the coins upwardly to the coin exit 160.

Figure 16:
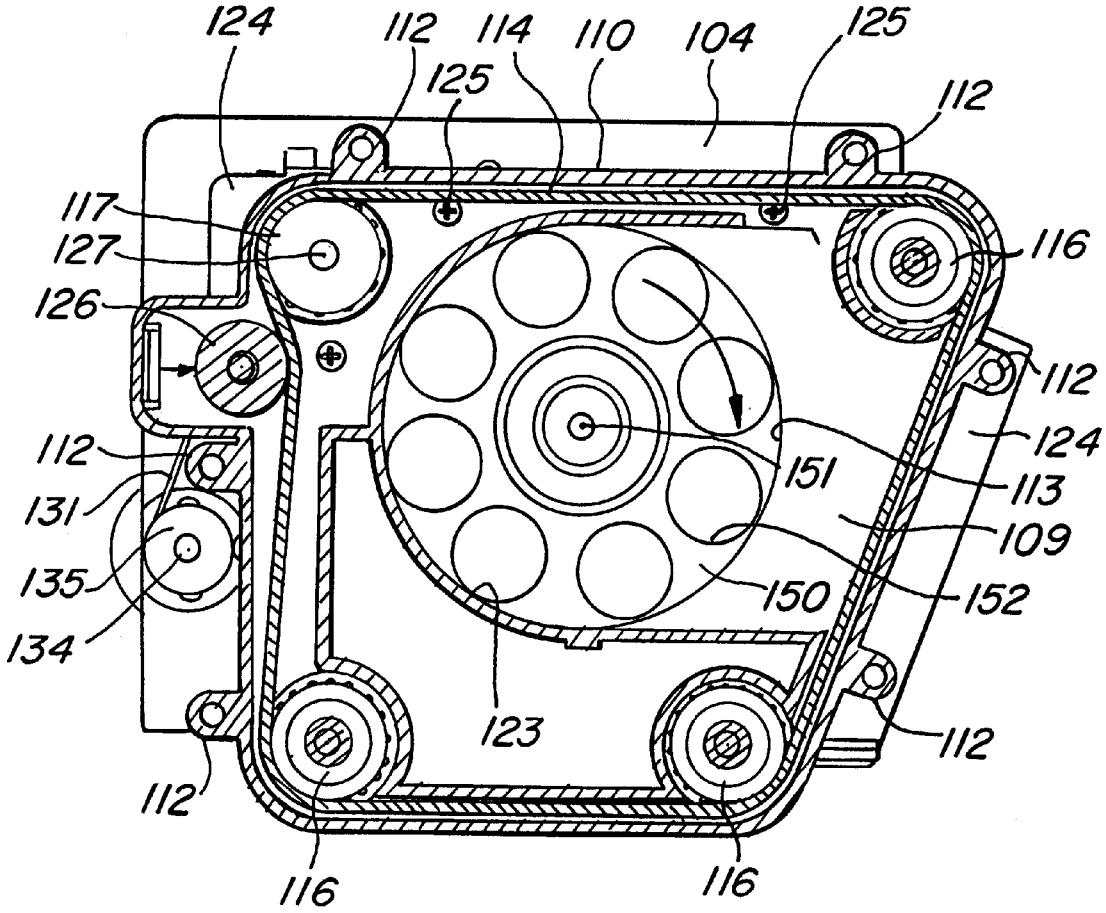
FIG. 16 is a sectional view of the coin dispensing apparatus in FIG. 15 shown from the front.

The second output shaft 143 is connected to a first pulley 138. The first pulley 138 drives a second pulley 136 using a pulley belt 137 when the motor 140 rotates in the reverse direction (see FIG. 12). The second pulley 136 is fixed to the end of a third shaft 134 rotatably supported by a bearing 133 fixed to the base plate 104 by screws 132. A third pulley 135 fixed to the other end of the third shaft 134 drives a fourth pulley 130 using a second pulley belt 131 (see FIG. 10). The fourth pulley 130 is fixed to the end of a fourth shaft 127 rotatably supported by a second bearing 129 fixed to a lid plate 124 by screws 128. The lid plate 124 is fixed to the back of the barrel case 110 by screws 125. The lid plate forms a back cover for the barrel case 110. A first conveyor pulley 117 fixed to the other end of the fourth shaft 127 drives the conveyor belt 114 within the barrel case 110 (see FIG. 16). The first conveyor pulley 117 is positioned at the upper left corner of the barrel case 110 on the lid plate 124.

The lid plate 124 has a circular opening 113 for transferring coins from the barrel case 110 to the first tank 101. The lid plate 124 also has a slide portion 119 inclined toward the opening 113 such that coins on the slide portion 119 slide down into the circular opening 113 (see FIG. 15). Conveyor guiding pulleys 116 are rotatably mounted on the lid plate 124 at the other three corners of the barrel case 110. The conveyor pulleys guide the conveyor belt 114 as it rotates along the inner wall of the barrel case 110 with the first conveyor pulley 117 driving the conveyor belt 114. Pulley cases 123 cover the conveyor pulleys within the barrel case 110. A tension roller 126 rotatably mounted on the lid plate 124 is used to adjust the tension of the conveyor belt 114. The tension roller 126 has a dumbbell shape with the center portion of the dumbbell applying force to the conveyor belt 114 in the direction indicated by the arrow next to the tension roller 126 in FIG. 16.

Figure 17:
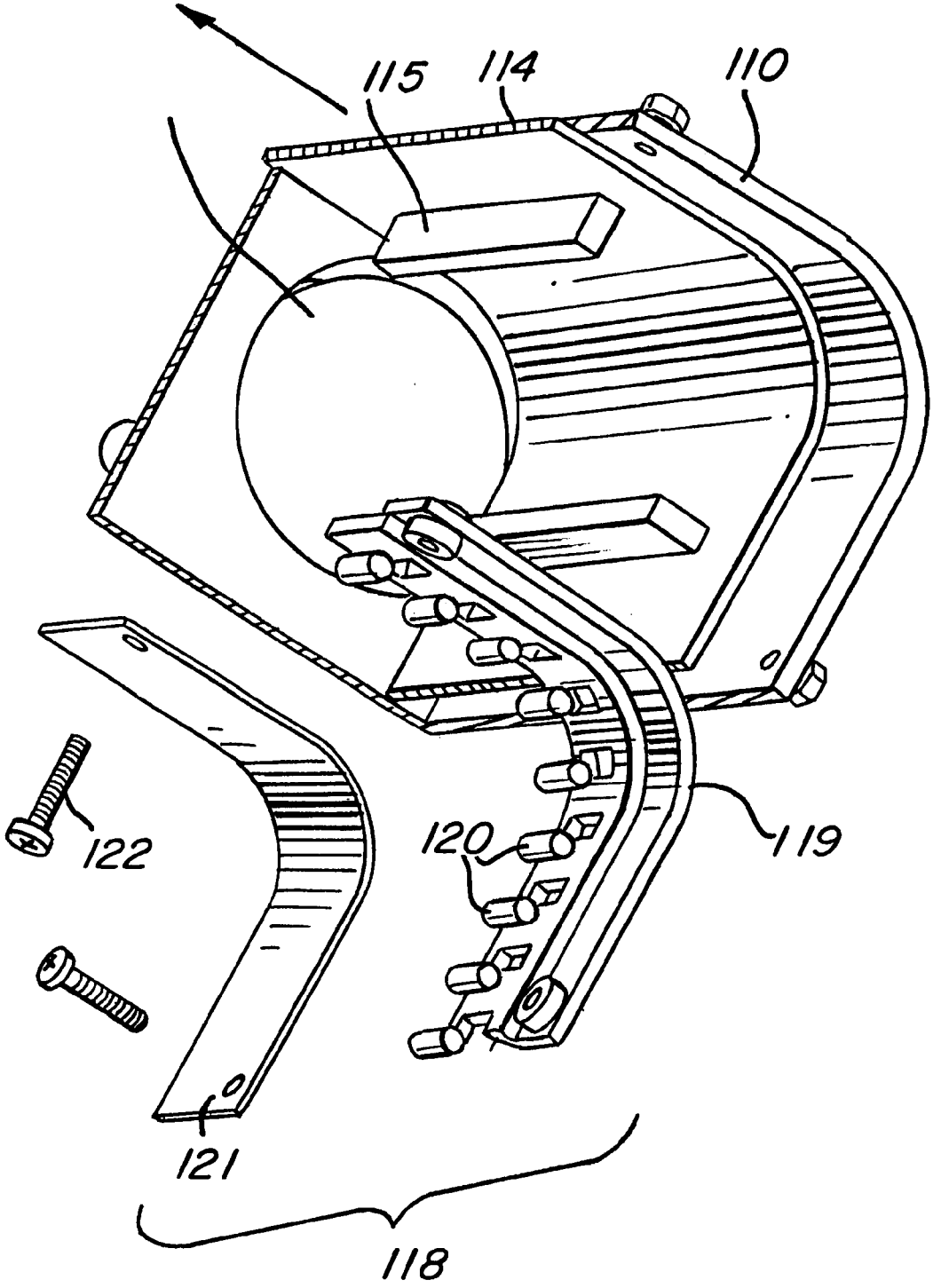
FIG. 17 is a decomposed perspective view of a section of the coin dispensing apparatus in FIG. 15.
Figure 18:
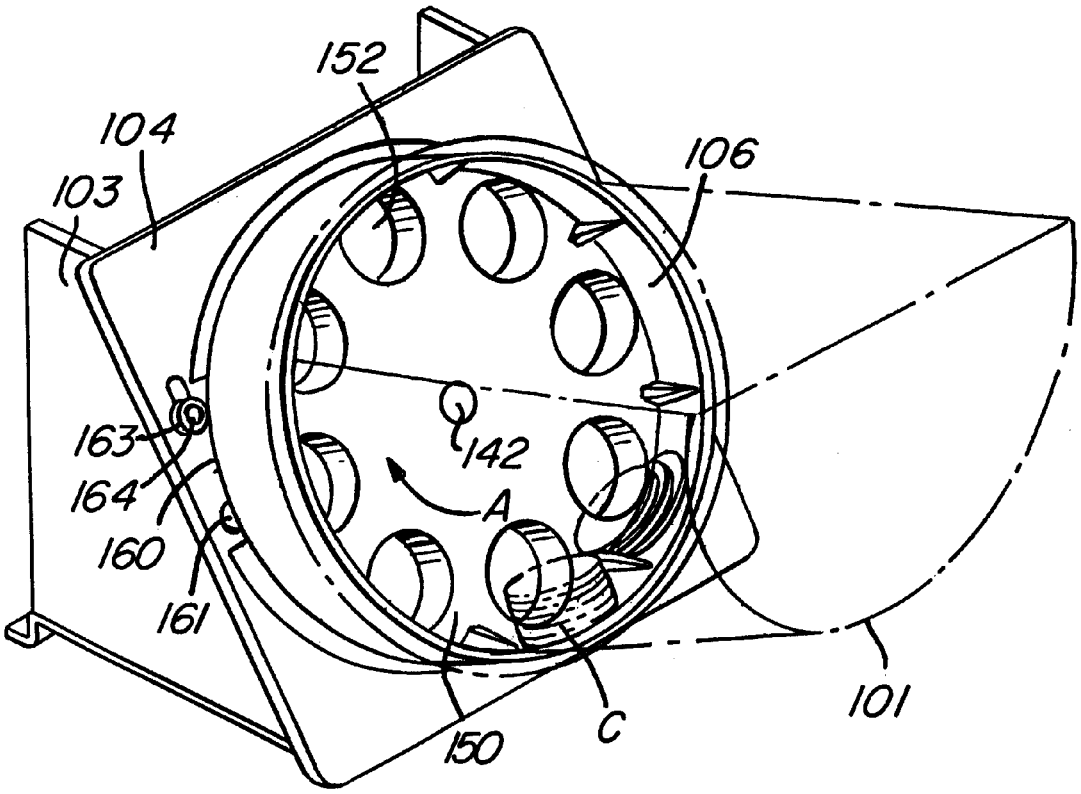
FIG. 18 PRIOR ART
FIG. 18 is a perspective view of a second hopper-type coin dispensing apparatus of the prior art.
Figure 19:
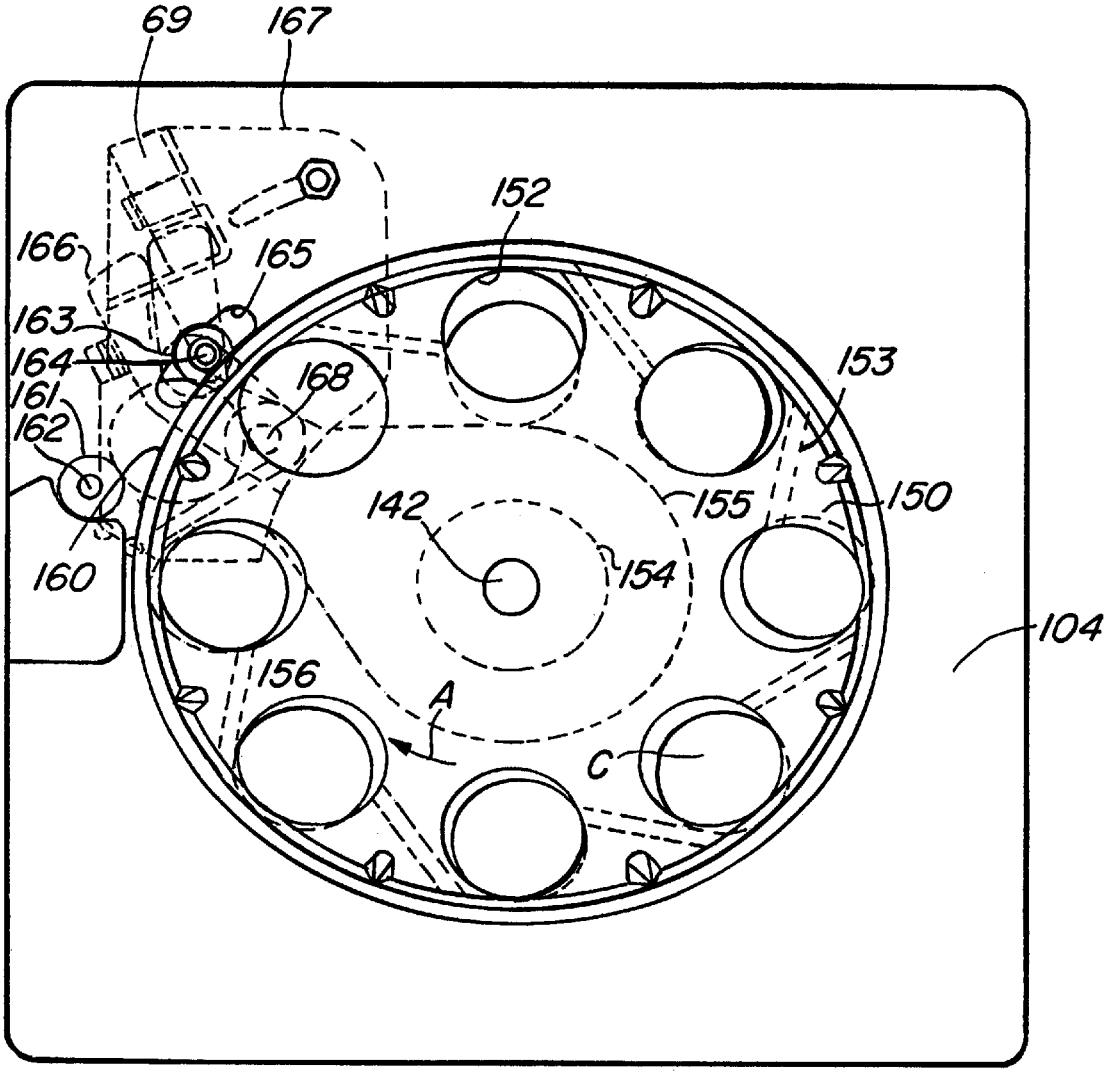
FIG. 19 PRIOR ART
FIG. 19 is a sectional view of the prior art coin dispensing apparatus in FIG. 18 shown from the front.

The barrel case 110 includes conveyor guides 118 for guiding the edge of the conveyor belt 114 nearest to the second tank 102. The conveyor guides 118 each includes a roller frame 119 for guiding the edge of the conveyor belt 114, a plurality of rollers 120, and a slender frame 121 for retaining the plurality of rollers 120 (see FIG. 17). The conveyor belt 114 is guided by sliding across the plurality of rollers 120. The slender frame is secured to the barrel case by bolts 122.

The conveyor belt 114 includes projections 115 extending partially across the width of the conveyor 114 for transporting coins upwardly within the barrel case 110 to the slide portion 109 of the barrel case. As the conveyor belt 114 rotates, coins on the projections 115 fall into the slide portion of the barrel case. The coins then slide down the slide portion 109 into the opening 113 to the first tank 101.

The second tank 102 is made from molded resin or metal in the shape of a large pot and has a large opening to the barrel case 110. The second tank 102 has a large mouth 105 for loading a supply of coins into the second tank 102. The coin supply in the second tank 102 flow into the barrel case 110 through the large opening due to gravity.

The large-capacity coin dispensing apparatus of the second embodiment increases coin capacity over the prior art coin dispensing apparatus by adding a second tank to hold a large supply of coins. The coin supply of the second tank 102 flow into the barrel case 110 through the large opening. The coins in the barrel case 110 initially flow into the first tank 101 through the circular opening 113 due to gravity. This occurs as long as the height of the coin supply in the barrel case 110 is above the circular opening 113. During this time, the conveyor 114 is not needed to lift the coins to the circular opening 113. When a sensor 170 determines the height of the coin supply in the barrel case 110 drops below the circular opening 113, the conveyor 114 is activated to lift the coins to the circular opening 113 and into the first tank 101. The coins are lifted on the projections 115 of the conveyor 114. When the projections 115 reach the circular opening 113, the coins slide off the projections 115 and drop into the first tank 101 through the opening 113. The coins slid off the projections 115 and drop into the first tank 101 because the case 110 is inclined to the horizontal.

Those skilled in the art will appreciate that various adaptations and modifications of the just-described second preferred embodiment of the present invention can be made without departing from the scope and spirit of the invention. For example, two motors can be used to separately rotate the rotary disc 150 and the conveyor 114 instead of a single motor 140. Furthermore, different types of conveyors can be used including a belt-type conveyor having rectangular segments connected by hinge pins into an endless loop, and a chain-like conveyor having links that fit into the sprockets of a sprocket wheel used in place of the conveyor pulley. Those skilled in the art will also appreciate that, with some modification to the coin dispensing apparatus of the second embodiment, the rotary disc can be replaced by the rotary disc of the first hopper-type coin dispensing apparatus.

What is claimed is:

1. A large-capacity coin dispensing apparatus comprising:

a first coin storage tank having an opening;

a rotary disc mounted in the first tank for picking up and dispensing coins from the first tank;

a cover member partially covering the first tank opening;

a second coin storage tank operatively connected to the first tank opening;

an endless conveyor belt mounted adjacent to the cover member and extending below a lower interior surface of the second tank for lifting coins from the second tank and dropping them into the first tank through the first tank opening.

2. The coin dispensing apparatus of claim 1 further comprising a support stand wherein the first and second tank are secured to the support stand in a position inclined to the horizontal.

3. The coin dispensing apparatus of claim 2 further comprising a sensor for detecting the coin load of the rotary disc and activating the conveyor belt when a sensor detects a decrease in the coin load.

4. The coin dispensing apparatus of claim 2 wherein the cover plate includes a guide rail for guiding the endless conveyor belt.

5. A large-capacity coin dispensing apparatus comprising:

a base plate inclined to the horizontal;

a first tank secured to the base plate;

a rotary disc rotatably mounted to the base plate within the first tank for picking up and dispensing coins from the first tank;

a case secured to the first tank having a first opening to the first tank;

a endless conveyor belt housed in the case for lifting coins in the case and dropping them into the first tank through the first opening;

a motor for driving the conveyor;

a second tank secured to the case for holding a supply of coins and having a second opening to the case extending to a lower interior surface of the second tank.

6. The coin dispensing apparatus of claim 5 wherein the endless conveyor extends below a lower interior surface of the second tank.

7. The coin dispensing apparatus of claim 5 wherein the conveyor comprises rectangular segments having racks on a bottom surface connected by hinge pins into an endless loop.

8. The coin dispensing apparatus of claim 7 further comprising:

a motor case fixed to the inside of the case housing the motor;

a motor shaft fixed to the motor protruding from the motor case;

a first gear fixed to the end of the motor shaft;

a second gear rotatably mounted to the motor case engaging the first gear and the racks of the belt-type conveyor.

9. The coin dispensing apparatus of claim 5 further comprising a sensor for detecting the coin load of the rotary disc and activating the motor when the sensor detects a decrease in the coin load.

10. The coin dispensing apparatus of claim 6 wherein the case includes a first guide rail encircling the first opening for guiding the belt-type conveyor.

11. The coin dispensing apparatus of claim 10 wherein the second tank includes a second guide rail encircling the second opening and parallel to the first guide rail for guiding the belt-type conveyor in conjunction with the first guide rail.

12. The coin dispensing apparatus of claim 6 wherein the conveyor includes projection plates on an upper surface for lifting coins on the belt-type conveyor and dropping them into the first tank through the first opening.

13. The coin dispensing apparatus of claim 12 wherein each of the projection plates extends horizontally across the width of the belt-type conveyor.

14. An large-capacity coin dispensing apparatus comprising:

a base plate inclined to the horizontal;

a first tank secured to the base plate;

a rotary disc rotably mounted to the base plate within the first tank for picking up and dispensing coins from the first tank;

a case secured to the first tank having a first opening to the first tank;

a endless conveyor belt running along the inner wall of the case for lifting coins in the case and dropping them into the first tank through the first opening;

a conveyor pulley positioned at one of the inner corners of the case for driving the conveyor;

three guide pulleys each secured to one of the three remaining inner corners of the case for guiding the conveyor;

a second tank secured to the case for holding a supply of coins and having a second opening to the case extending to the bottom of the second tank.

15. The coin dispensing apparatus of claim 14 wherein the conveyor belt extends below the bottom of the second tank.

16. The coin dispensing apparatus of claim 14 wherein the rotary disc and the conveyor pulley are driven by a single motor having a motor shaft.

17. The coin dispensing apparatus of claim 16 wherein the motor drives the rotary disc when the motor shaft is rotated in a positive direction and drives the conveyor pulley when the motor shaft is rotated in a negative direction.

18. The coin dispensing apparatus of claim 13 wherein the conveyor includes projections on an upper surface each extending partially across the width of the conveyor for transporting coins upwardly on the conveyor.

19. The large-capacity coin dispensing apparatus of claim 18 further including a conveyor guide secured to one of the inner corners of the case having a plurality of rollers retained in a slender frame for guiding the conveyor, wherein the conveyor is guided by sliding across the plurality of rollers.

* * * * *